US005630846A

United States Patent [19]

Hara et al.

[11] Patent Number: 5,630,846

[45] Date of Patent: May 20, 1997

[54] AGENT FOR TREATING TEXTILE, METHOD FOR TREATING TEXTILE AND TREATED TEXTILE

[75] Inventors: Kazuto Hara; Yasuo Itami; Tetsuya Masutani; Nobuyuki Nose; Takashi Enomoto; Akihiko Ueda; Taro Sano; Motonobu Kubo, all of Osaka, Japan

[73] Assignee: Daikin Industries Ltd., Osaka, Japan

[21] Appl. No.: 256,623

[22] PCT Filed: Jan. 26, 1993

[86] PCT No.: PCT/JP93/00089

§ 371 Date: Aug. 5, 1994

§ 102(e) Date: Aug. 5, 1994

[87] PCT Pub. No.: WO93/15254

PCT Pub. Date: Aug. 5, 1993

[30] Foreign Application Priority Data

Jan. 27, 1992 [JP] Japan ..... 4-011883

[51] Int. Cl.[6] ..... D06M 13/298

[52] U.S. Cl. ..... 8/127.1; 8/115.64; 8/128.1; 8/115.68; 427/389.9; 427/389; 427/394; 428/224; 428/288; 428/289; 428/290

[58] Field of Search ..... 8/127.1, 115.64, 8/128.1, 115.68; 252/8.6, 8.8, 8.9; 427/389.9, 389, 394; 428/224, 288, 289, 290

[56] References Cited

U.S. PATENT DOCUMENTS

| | | | |
|---|---|---|---|
| 1,940,610 | 12/1933 | Somerville | 8/94.25 |
| 2,559,749 | 7/1951 | Benning | 526/193 |
| 3,083,224 | 3/1963 | Brace et al. . | |
| 3,096,207 | 7/1963 | Cohen | 427/384 |
| 5,256,318 | 10/1993 | Masutani et al. | 8/94.25 |

FOREIGN PATENT DOCUMENTS

| | | |
|---|---|---|
| 0340753 | 11/1989 | European Pat. Off. . |
| 2270364 | 9/1976 | France . |
| 2374327 | 12/1977 | France . |
| 2-215900 | 8/1990 | Japan . |
| 1559546 | 1/1980 | United Kingdom . |

OTHER PUBLICATIONS

Sharphouse, *Leatherworker's Handbook*, 1963, pp. 98 and 107 (month unknown).

*Primary Examiner*—Prince Willis, Jr.
*Assistant Examiner*—Alan D. Diamond
*Attorney, Agent, or Firm*—Birch, Stewart, Kolasch & Birch, LLP

[57] ABSTRACT

The present invention provides an agent for treating textile having a combination of a modifying agent and a fixing agent, wherein the modifying agent is a fluorine-containing phosphoric acid derivative represented by the formula wherein $R^1$ and $R^2$ are, same or different, a hydrogen atom or $R_f$—$(CH)_2)_m$— (wherein $R_f$ is a saturated or unsaturated, linear or branched fluorine containing aliphatic group having 4 to 20 carbon atoms in which an oxygen atom, a nitrogen atom, a sulfonyl group and/or an aromatic ring may intervene between the carbon atoms; and m is 1 or 2) ($R^1$ and $R^2$ each is not simultaneously a hydrogen atom), A is an oxygen atom, a sulfur atom or a direct bond, and n is 1 or 2, and having a molecular weight of not larger than 2,000 or a salt thereof, and the fixing agent is a metal salt compound; and a method for treating a textile by using the above agent for treating a textile and, if necessary, a fluorine-containing water- and oil-repellent or a fluorine-containing stainproofing agent. The present invention can maintain the touch, feeling, color shade and softness originally possessed by the fibers even if the textile is treated. The present invention can maintain the above properties even if the textile is subjected to a long term use including the washing and rubbing, and can impart hot water repellency and durable water- and oil-repellency.

26 Claims, No Drawings

AGENT FOR TREATING TEXTILE, METHOD FOR TREATING TEXTILE AND TREATED TEXTILE

This application is a 371 of PCT/JP93/00089 filed May 26, 1993.

BACKGROUND OF THE INVENTION

1. Field of the Invention

The present invention relates to an agent for treating a textile, a method for treating a textile and a treated textile.

2. Related Art

Hitherto, Japanese Patent Kokoku Publication Nos. 4503/1968 and 4770/1973 disclose that a fluorine-containing phosphate ester and a fluorine-containing phosphonic acid can give oil-repellency to a textile and a paper. However, when the fluorine-containing phosphate ester or the fluorine-containing phosphonic acid alone is used for treatment, then the touch, the feeling, the color shade and the softness of treated material are deteriorated because of the treatment, the initial water- and oil-repellency is insufficient and above properties are remarkably deteriorated by a wash and/or rub.

Japanese Patent Kokai Publication No. 215900/1990 discloses a method for treating a leather with a fluorine-containing phosphoric acid compound and a cationic compound. However, this document does not disclose the treatment of the textile which is required to have the good touch, feeling, color shade and softness. U.S. Pat. No. 2,662,835 discloses a method for treating a fiber material with a chromium complex salt of a fluorine-containing carboxylic acid. However, this document does not disclose the water- and oil-repellency and the method of this document gives no sufficient effect even if used in a high concentration, and gives remarkably discolored fibers.

U.S. Pat. No. 3,096,207 discloses a method for treating a leather and a fiber with a fluorine-containing phosphoric acid compound or a metal salt thereof. However, since this document discloses the treating agent and treating method which are different from those of the present invention, this document gives the worse effect and durability than the present invention.

By the way, a fluorine-containing polymeric compound which is generally used, for example, an acrylic polymeric compound containing a fluoroalkyl group is used for the treatment, the treated textile suffers from the disadvantages that the originally possessed touch, feeling, softness and the like are remarkably deteriorated because of the treatment and that the above properties and water- and oil-repellency are remarkably deteriorated when the textile is washed or rubbed. The initial performances are very poor for a nylon having high hydrophilic property and the other fibers. It is known that, in the case that the textile is slightly washed, the performances are recovered to some extent by the use of a heating treatment such as a process for ironing the textile. But, an operation of the heating treatment is very troublesome.

Recently, in order to improve the durability, when an acrylic polymer containing an fluoroalkyl group is used for the treatment, an auxiliary is used together. Specific examples of the auxiliary are a melamine resin and a urea resin. When these resins are used together with the acrylic polymer, the deterioration of the feeling of the fibers tends to be more significant than that of the fibers treated with that the polymer alone. It seems that the durability has the relationship contrary to the softness when the fluorine-containing polymer is used.

The acrylic polymer having the fluoroalkyl group has a low glass transition temperature ($T_g$). When the temperature of the acrylic polymer is higher than $T_g$, the arrangement of the fluoroalkyl group causing the water- and oil-repellency is disordered so that the water- and oil repellency is remarkably decreased. Therefore, the acrylic polymer is very weak to hot water, and lacks in the hot water repellency.

As stated above, when any of the conventional treating agents and methods is used, the properties originally possessed by a natural or synthetic fiber are deteriorated by the treatment and the water- and oil-repellency given by the treatment is deteriorated by a wash and the like.

SUMMARY OF THE INVENTION

Problems to be Solved by the Invention

An object of the present invention is to keep the touch, feeling, color shade (clarity), and softness originally possessed by the fibers even after the treatment, to keep the above properties even after a long time use including a wash and to impart hot water-repellency, durable water- and oil repellency and soil releasability.

Means for Solving the Problems

According to one aspect, the present invention provides an agent for treating a textile, comprising a combination of a modifying agent and a fixing agent, wherein the modifying agent is a fluorine-containing phosphoric acid derivative represented by the formula:

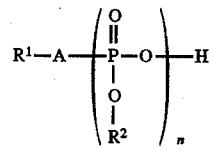

(I)

wherein $R^1$ and $R^2$ are, same or different, a hydrogen atom or $R_f$—$(CH_2)_m$— (wherein $R_f$ is a saturated or unsaturated, linear or branched fluorine-containing aliphatic group having 4 to 20 carbon atoms in which an oxygen atom, a nitrogen atom, a sulfonyl group and/or an aromatic ring may intervene between the carbon atoms; and m is 1 or 2) ($R^1$ and $R^2$ each is not simultaneously a hydrogen atom), A is an oxygen atom, a sulfur atom or a direct bond, and n is 1 or 2, and having a molecular weight of not larger than 2,000 or a salt thereof, and the fixing agent is a metal salt compound.

According to a second aspect, the present invention provides a method for treating a textile with said treating agent.

According to a third aspect, the present invention provides a textile treated with said treating agent.

According to a fourth aspect, the present invention provides a method for treating a textile, comprising two steps of treating the textile with said treating agent; and then treating the textile with a fluorine-containing water- and oil-repellent or a fluorine-containing stainproofing agent.

DETAILED DESCRIPTION OF THE INVENTION

In the present invention, after the textile is treated with the fixing agent, the textile may be treated with the modifying agent. Alternatively, after the textile is treated with the modifying agent, the textile may be treated with the fixing agent.

In the present invention, the use of the combination of the modifying agent and the fixing agent can keep the touch, feeling, color shade and softness originally possessed by the fibers for a long time, and can give a strong bond between the fibers and the fluorine-containing phosphoric acid derivative so that the exfoliation of the fluorine-containing phosphoric acid derivative from the fibers is prevented.

According to the present invention, the modifying agent is the fluorine-containing phosphoric acid derivative of the above formula (I) or the salt thereof. The fluorine-containing phosphoric acid derivative is a compound which has both of a P—OH linkage and an organic fluorine-containing group. The organic fluorine-containing is usually a fluorine-containing aliphatic group, particularly a saturated or unsaturated, linear or branched fluorine-containing aliphatic group and includes a group in which an oxygen atom, a nitrogen atom, a sulfonyl group and/or an aromatic group intervene in a carbon-carbon linkage. Specific examples of the salt of the fluorine-containing phosphoric acid derivative are a salt of a monovalent metal such as a sodium salt, a potassium salt, a lithium salt and the like, an organic amine salt such as a diethanolamine salt, a triethylamine salt, a propylamine salt, a morpholine amine salt and the like, and an ammonium salt. These compounds have water- and oil-repellency.

Specific examples of the fluorine-containing phosphoric acid derivative are as follows and are not limited to the following compounds:

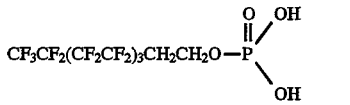

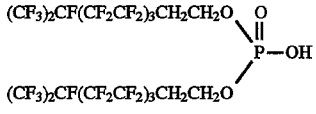

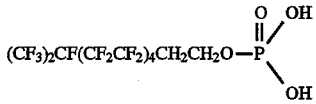

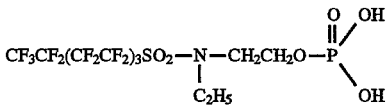

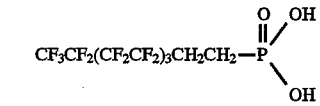

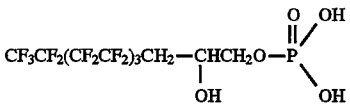

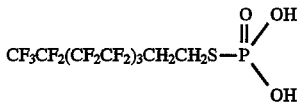

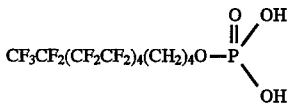

-continued

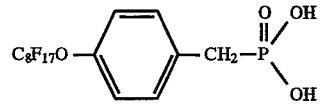

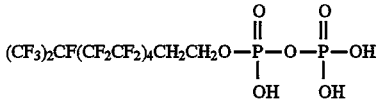

In the present invention, a metal in the metal salt compound used as the fixing agent can ionically bond to a hydroxyl group bonding to a phosphorus atom, may be a metal having the valency of at least two and may be preferably chromium, zirconium, titanium, aluminum or the like. In view of the color shade, zirconium, titanium, aluminum and the like are more preferable. The metal salt compound is preferably water-soluble and is preferably, for example, a chloride, a nitrate salt, a sulfate salt, a hydroxide and the like.

In the present invention, the treated textile may be in the form of a fiber as such, or a yarn, a woven fabric, a knitted fabric, a nonwoven fabric and the like which are formed from the fibers. Specific examples of the textile are a natural fiber such as cotton, wool and silk; and a chemical fiber including a synthetic fiber such as an acryl, a nylon, a cellulose, a polyester and the like. The present invention is particularly effective to a protein fiber and a polyamide fiber such as silk and nylon. The present invention is suitable for a yarn, or a woven, knitted or nonwoven fabric formed from recently significantly developed extra fine fibers, particularly an artificial leather which is one of nonwoven fabrics formed from the extra fine fibers in view that the feeling and touch are important. The extra fine fiber has not larger than 1 denier, preferably from 1 to 0.0001 denier, more preferably from 0.1 to 0.001 denier. The textile suitable for the present invention is a carpet. After forming the carpet from the yarn, the carpet may be treated according to the present invention. Alternatively, after treating the yarn according to the present invention, the carpet may be formed from the yarn.

In the present invention, the used carpet may be made of any of materials such as a polyamide such as a nylon, a polyester and an acryl and the material of the carpet is not limited. The present invention is particularly suitable for a nylon carpet which is usually used under severe conditions. The structure, the weave design, the pile length of the carpet are not limited.

According to the present invention, the textile is treated with the above agent for treating the textile. Anyone of the modifying agent and the fixing agent may be used earlier as described below. The treating method with the modifying agent and the fixing agent includes the following methods (i), (ii) and (iii).

(i) Firstly, the method comprising treating the textile with the fixing agent and then with the modifying agent is explained. The textile is immersed in a solution of the fixing agent and pulled up from the solution, and water is squeezed from the textile. The textile is then immersed in a solution of the modifying agent; a solution of an acid is added to the solution of modifying agent to adjust pH of the solution of modifying agent to a range between 1 and 5, preferably between 3 and 4; the textile is kept standing; water is squeezed from the textile; the textile is sufficiently washed with water; water is squeezed from the textile; and the textile is dried. Alternatively, the textile is immersed in a solution of the modifying agent; water is squeezed from the textile;

the textile is immersed in a solution of an acid; water is squeezed from the textile; the textile is sufficiently washed with water; water is squeezed from the textile; and the textile is dried.

(ii) The immersion in the fixing agent solution may be conducted after the immersion in the modifying agent solution. Firstly, the textile is immersed in a solution of the modifying agent; the textile is pulled up from the solution and water is squeezed from the textile. Then, the textile is immersed in a solution of the fixing agent; a solution of an acid is added to the solution of the fixing agent to adjust pH of the solution of the fixing agent to a range between 1 and 5, preferably between 3 and 4; the textile is kept standing; water is squeezed from the textile; the textile is sufficiently washed with water; water is squeezed from the textile; and the textile is dried. Alternatively, the textile is immersed in the solution of the fixing agent; water is squeezed from the textile; the textile is immersed in a solution of an acid; the water is squeezed from the textile; the textile is sufficiently washed with water; water is squeezed from the textile; and the textile is dried.

(iii) Alternatively, a series of the above procedures can be conducted in the same bath. For example, after the textile is immersed in a solution of the fixing agent, and the modifying agent is added to the solution to immerse the textile in the solution. Further, a solution of an acid is added to the solution containing the fixing agent and the modifying agent to adjust pH of the solution to a range between 1 and 5, preferably between 3 and 4, the textile is kept standing in the solution, water is squeezed from the textile, and the textile is sufficiently washed with water. Then water is squeezed from the textile and the textile is dried. After the textile is immersed in the solution of the modifying agent, the fixing agent or the solution thereof may be added.

In the above methods (i), (ii) and (iii), the solution of the fixing agent is usually an aqueous solution containing usually 0.001 to 20% by weight, preferably 0.01 to 10% by weight of the fixing agent, based on the weight of the treated textile. The temperature of the solution of the fixing agent is usually from 20° to 70° C. The solution of modifying agent is usually an aqueous or alcoholic solution containing usually from 0.001 to 50% by weight, preferably from 0.01 to 20% by weight of the modifying agent, based on the weight of the treated textile. The temperature of the solution of the modifying agent is usually from 5° to 90° C., preferably from 20° to 70° C. The solution of the acid which is used for the immersion or the adjusting of pH is a solution, preferably an aqueous solution containing a mineral acid such as hydrochloric acid and sulfuric acid, or an organic acid such as formic acid, acetic acid and propionic acid. The concentration of the solution of the acid is not limited and is usually from 0.05 to 30% by weight, preferably from 0.1 to 5% by weight. The temperature of the solution of the acid is usually from 5° to 90° C., preferably from 20° to 70° C. The time during which the textile is immersed in the fixing agent solution, the modifying agent solution or the acid solution is usually at least 10 seconds, preferably from 1 to 120 minutes, more preferably from 1 to 30 minutes. The standing time in the bath having the adjusted pH of 1 to 5 is usually at least 10 seconds, preferably from 1 to 30 minutes. The drying temperature is usually from 10° to 70° C., preferably a room temperature. The drying time varies according to the drying conditions (particularly the drying temperature), but is usually not larger than 24 hours, preferably from 0.1 to 10 hours. When the immersion is conducted in the same bath, a weight ratio of the fixing agent to the modifying agent is usually from 0.1:1 to 10:1.

In the present invention, if necessary, another treating agent or treating method may be used together with the agent and method of the present invention. For example, the treatment with a conventional fluorine-containing water- and oil-repellent, the softening finish with a silicone, and the resin treatment can be used. A fluorine-containing stainproofing agent may be used. It is preferable to use the treatment with the fluorine-containing water- and oil-repellent or the fluorine-containing stainproofing agent depending on the use.

In the present invention, other treating agent or additive, for example, a soil release (SR) agent, an antistatic agent, a flame retardant, an anti-fungus agent and a non-shrinking agent may be used.

In the present invention, a typical example of the fluorine-containing water- and oil-repellent which is used in the second step of the treatment is a conventional well-known fluorine-containing water- and oil-repellent having a perfluoroalkyl group as a side chain. Specific examples of the fluorine-containing water- and oil-repellent are polymers and copolymers of the following monomers:

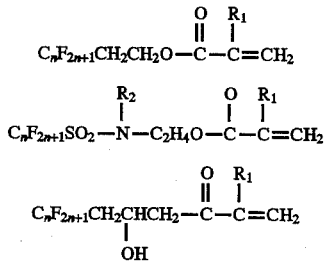

wherein $R_1$ is a hydrogen atom or a methyl group, $R_2$ is a methyl group or an ethyl group, and n is an integer of 5 to 21.

In the present invention, the fluorine-containing stainproofing agent used in the second step may be a polyfluoroalkyl group-containing urethane compound, a polyfluoroalkyl group-containing ester compound or the like. Typical examples of the fluorine-containing stainproofing agent may be the following compounds, but are not limited to the following compounds. For example, the above compounds mentioned as the fluorine-containing water- and oil repellent can be used as the fluorine-containing stainproofing agent. A silicone stainproofing agent can be used instead of the fluorine-containing stainproofing agent.

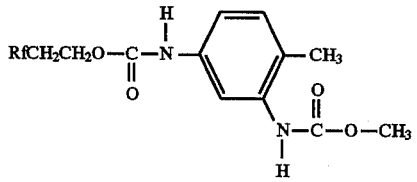

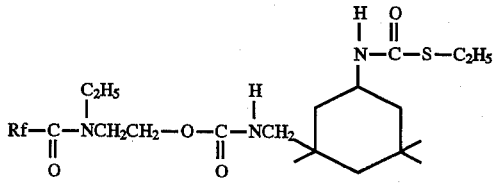

-continued

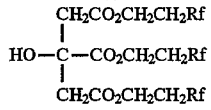

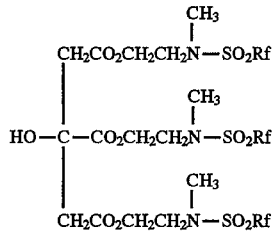

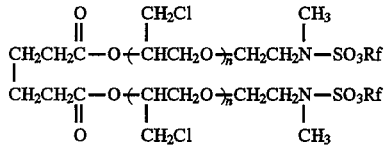

wherein $R_f$ is $C_nF_{2n+1}$ (n is an integer of 5 to 21).

The fluorine-containing stainproofing agent may be used together with various auxiliaries such as a melamine resin, a urea resin, a blocked isocyanate, and glyoxal.

In the second step, the textile which has been treated in the first step is treated with the fluorine-containing water- and oil-repellent or the fluorine-containing stainproofing agent. The second step may be conventionally used treatment, for example, a spraying technique, a foam technique, an immersion technique, an impregnation technique, a padding technique or a coating technique is used, and then the textile is dried. An auxiliary such as a melamine resin or a urea resin may be used together with the fluorine-containing water- and oil-repellent or the fluorine-containing stainproofing agent. If necessary, further, a thermal treatment or a calendering may be further conducted. A treating agent other than a fluorine-containing compound (such as a silicone compound) may be used together.

The used fluorine-containing water- and oil repellent and fluorine-containing stainproofing agent may be in the form of any of an emulsion and an solution in an organic solvent. In the case of the aqueous emulsion, it is preferable to add, to the emulsion, a water-soluble lower alcohol or ketone (isopropyl alcohol is particularly preferable) in an amount of 0.1 to 10% by weight, more preferably from 1 to 5% by weight based on the emulsion, since the fluorine-containing water- and oil-repellent and the like can easily penetrate in the textile.

The two steps can be conducted for any of textiles. For example, the first and second steps may be conducted for the finished carpet. Alternatively, the first and second steps may be conducted for a raw yarn or fiber used for the carpet, and then the carpet can be formed from the treated yarn or fiber. Alternatively, the first step may be conducted for the raw yarn or fiber and then the second step may be conducted for the finished carpet.

Since a complex is formed between the fluorine-containing phosphoric acid derivative and a metal coordinated or fixed to a bundle of fibers, the present invention can keep the touch, the feeling, the color shade (clarity) and the softness originally possessed by the fibers and can give the keeping of the above properties for a long time and durable water- and oil-repellency which are not given by the conventional agents for treating the textile. Since in the present invention, the fluorine-containing phosphoric acid derivative is penetrated in the bundle of fibers and then fixed, the present invention does not suffer from the disadvantage that only the surface of fabric has the water- and oil-repellency. In the present invention, even if the textile is thick, internal parts of the textile can have the good properties. The present invention can give the same effect to various forms of the textiles, such as the fiber, the yarn, the woven fabric, the knitted fabric, the nonwoven fabric and the like.

When the textile is treated with the agent for treating textile in the first step and then with the fluorine-containing oil- and water-repellent in the second step, the deterioration of the feeling and softness observed in the use of only the fluorine-containing water- and oil-repellent treatment is surprisingly improved. Even if the auxiliary such as the melamine resin, the blocked isocyanate and the like is used together, the present invention can give the unexpected effect that the treated textile has the same feeling as the feeling of the untreated textile. In addition, the durability of the water- and oil-repellency can be strengthened.

Since the textile of the present invention has the above advantages, it can be used for the application in which the textile is particularly required to have the good water- and oil-repellency and soil release property, for example, for the application in which the textile is subjected to wind and rain in outdoor. Specific examples of the application in which the textile is subjected to wind and rain are a tent, an automobile cover, a cover for two-wheeled vehicle, a convertible top for a load-carrying platform of a truck, a covering sheet for construction work, an umbrella, clothes [particularly, a rainwear (for example, a raincoat, a rain jacket and the like)], and the like. In addition, the textile is used for a hat, a cap, a foot wear (for example, shoes and slippers), a suitcase, a bag, a textile used for a cover of an article for sitting down (for example, a seat such as a car seat and a theater seat, a sofa and a chair), a curtain, a rug or mat, an interior article for a wall or ceiling of a built structure or vehicle (for example, an automobile, a train, an aircraft, a ship and the like), and various displays. Among the above applications, the present invention is preferable to the textile which is difficultly cleaned, the textile which is easily stained, and the textile which cannot be washed many times.

PREFERRED EMBODIMENT OF THE INVENTION

The present invention will be illustrated by the following Examples which do not limit the present invention. In the following Examples, % is by weight unless specified.

The water repellency shown in Examples 1–18 and Comparative Examples 1–10 is measured according to JIS (Japanese Industrial Standard) L-1092-1977 and expressed by the water repellency shown in the following Table 1. The water repellency shown in Examples 19–23 and Comparative Examples 11–14 is determined by quietly dropping several drops of a test isopropyl alcohol/water mixture shown in Table 2 on a surface of a sample, observing the penetration state of the drops after 3 minutes and expressing, as the water repellency, the maximum content of isopropyl alcohol in the drop keeping the shape of the drops. The oil repellency is measured according to AATTC TM-118-1975 and determined by dropping oils having different surface tensions shown in Table 3 on the sample and expressing, as a value of the oil repellency, the maximum value of the oil having no penetration after 30 seconds.

TABLE 1

| Water repellency | State |
|---|---|
| 100 | No wet on the surface |
| 90 | Slight wet on the surface |
| 80 | Partial wet on the surface |
| 70 | Wet on the surface |
| 50 | Wet over the whole surface |
| 0 | Complete wet on the front and back surfaces |

TABLE 2

| Composition of mixture (vol %) | |
|---|---|
| Isopropyl alcohol | Water |
| 0 | 100 |
| 10 | 90 |
| 20 | 80 |
| 30 | 70 |
| 40 | 60 |
| 50 | 50 |

TABLE 3

| Oil repellency | Surface tension | Standard liquid |
|---|---|---|
| 0 | — | Inferior to 1 |
| 1 | 31.45 | Nujol |
| 2 | 29.6 | Nujol/n-hexadecane = 65/35 (% by volume) |
| 3 | 27.3 | n-Hexadecane |
| 4 | 26.35 | n-Tetradecane |
| 5 | 24.7 | n-Dodecane |
| 6 | 23.5 | n-Decane |
| 7 | 21.4 | n-Octane |
| 8 | 19.75 | n-Heptane |

The wash resistance is measured according to JIS-L-0217-103 and expressed by the water repellency and the oil repellency before and after washing the textile 20 times.

The hot water repellency is measured by the use of 75° C hot water according to JIS-L-1092-1977 and expressed in the same manner as in the water repellency.

The superscript "+" to the water repellency and the hot water repellency represents that the result is slightly better than said water repellency and said hot water repellency, respectively. The superscript "–" to the water repellency and the hot water repellency represents that the result is slightly inferior to said water repellency and said hot water repellency, respectively.

The dry soil releasability is measured according to JIS-L-1021-1979 as follows. A sample is stirred at 50 revolutions and contaminated with a dry soil having a composition shown in Table 4. After a residual soil of the sample is removed by the use of an electrical vacuum cleaner, the brightness of the sample surface is measured by a colorimeter and a contamination ratio is calculated according the following equation to evaluate the soil releasability of dry soil.

$$\text{Contamination ratio (\%)}=[(L_0-L)/L_0]\times 100$$

wherein $L_0$ is the brightness of the sample before the contamination, and L is the brightness of the sample after the contamination.

TABLE 4

| Components | % by weight |
|---|---|
| Peat moss | 38 |
| Cement | 17 |
| White clay | 17 |
| Diatomaceous earth | 17 |
| Carbon black | 1.75 |
| Ferric oxide | 0.5 |
| Nujol | 8.75 |

The rub resistance is measured by the use of Gakushin-type friction tester according to JIS-L-0823-1971. A sample is rubbed 3,000 times under a load of 500 g, and the water- and oil-repellency of a rubbed part of the sample is evaluated to give the value of the rub resistance.

The feeling is evaluated by touching the sample according to the standard shown in FIG. 5.

TABLE 5

| Rank | Feeling |
|---|---|
| ○ | Good |
| Δ | Slightly poor |
| X | Poor |

EXAMPLE 1

Each of various textile fabric samples (nylon-6 taffeta, habutae silk and acrylic muslin; size: 20 cm×20 cm square) was immersed in a 0.1% aqueous solution of chromium sulfate (trade name: Bay Chrom F manufactured by Bayer AG) (a bath ratio of 50:1) at 40° C. for 10 minutes, and water was squeezed from the sample. The sample was immersed in a 0.125% aqueous solution of a Compound 11 (a fluorine-containing phosphoric acid derivative) (a bath ratio of 40:1) shown in Table 6 at 40° C. for 10 minutes. A 0.1% aqueous solution of formic acid was added to the bath to adjust pH of the content in the bath to 3. The textile was kept standing in the bath for 10 minutes, water was squeezed from the textile, the textile was washed with water at 40° C. and then the textile was dried at a room temperature. The touch, feeling, softness of each textile sample were evaluated before and after the treatment to reveal that these properties were the same before and after the treatment. These properties were the same before and after the washing. In addition, the water repellency and the oil repellency of each textile sample were measured before and after the washing. The results are shown in Table 7.

EXAMPLE 2

The same procedure as in Example 1 was repeated except that a 0.1% aqueous solution of zirconium sulfate (trade name: Brancorol ZB 33, manufactured by Bayer AG) was used instead of the aqueous chromium sulfate solution. The results are shown in Table 7.

EXAMPLE 3

The same procedure as in Example 1 was repeated except that a 0.1% aqueous solution of aluminum chloride (trade name: Lutan FS, manufactured by BASF AG) was used instead of the aqueous chromium sulfate solution. The results are shown in Table 7.

EXAMPLE 4

The same procedure as in Example 1 was repeated except that a Compound 12 shown in Table 6 was used as the fluorine-containing phosphoric acid derivative. The results are shown in Table 7.

EXAMPLE 5

The same procedure as in Example 2 was repeated except that a Compound 12 shown in Table 6 was used as the fluorine-containing phosphoric acid derivative. The results are shown in Table 7.

EXAMPLE 6

The same procedure as in Example 3 was repeated except that a Compound 12 shown in Table 6 was used as the fluorine-containing phosphoric acid derivative. The results are shown in Table 7.

EXAMPLE 7

The same procedure as in Example 1 was repeated except that the treatment with the aqueous solution of chromium sulfate and the treatment with the aqueous solution of fluorine-containing phosphoric acid derivative were in reverse order. The results are shown in Table 7.

EXAMPLE 8

The same procedure as in Example 2 was repeated except that the treatment with the aqueous solution of zirconium sulfate and the treatment with the aqueous solution of fluorine-containing phosphoric acid derivative were in reverse order. The results are shown in Table 7.

EXAMPLE 9

The same procedure as in Example 3 was repeated except that the treatment with the aqueous solution of aluminum chloride and the treatment with the aqueous solution of fluorine-containing phosphoric acid derivative were in reverse order. The results are shown in Table 7.

EXAMPLE 10

The same procedure as in Example 4 was repeated except that the treatment with the aqueous solution of chromium sulfate and the treatment with the aqueous solution of fluorine-containing phosphoric acid derivative were in reverse order. The results are shown in Table 7.

EXAMPLE 11

The same procedure as in Example 5 was repeated except that the treatment with the aqueous Solution of zirconium sulfate and the treatment with the aqueous solution of fluorine-containing phosphoric acid derivative were in reverse order. The results are shown in Table 7.

EXAMPLE 12

The same procedure as in Example 6 was repeated except that the treatment with the aqueous solution of aluminum chloride and the treatment with the aqueous solution of fluorine-containing phosphoric acid derivative were in reverse order. The results are shown in Table 7.

COMPARATIVE EXAMPLE 1

The same procedure as in Example 1 was repeated except that the solution of chromium sulfate was not used. The results are shown in Table 7.

COMPARATIVE EXAMPLE 2

Each of the same textile samples as in Example 1 was treated with TG-230 (a fluorine-containing polymeric compound, manufactured by Daikin Industries Ltd.) at a solid content of 0.125% (a bath ratio: 40:1) at 25° C. for 10 minutes. The textile sample was dried at 80° C. for 3 minutes and then cured at 130° C. for 3 minutes. The water repellency and the oil repellency of each textile sample were measured before and after washing the textile sample. The results are shown in Table 7.

COMPARATIVE EXAMPLE 3

Each of the same textile samples as in Example 1 was treated with Scotch guard 233A (a fluorine-containing chromium carboxylate complex salt, manufactured by 3M Company) at a solid content of 0.125% (a bath ratio: 40:1) at 25° C. for 10 minutes. The textile sample was dried at 80° C. for 3 minutes and then cured at 130° C. for 3 minutes. The water repellency and the oil repellency of each textile sample were measured before and after washing the textile sample. The results are shown in Table 7.

COMPARATIVE EXAMPLE 4

The same procedure as in Comparative Example 3 was repeated except that the solid content was 1.5%. The results are shown in Table 7.

In all of Comparative Examples 1 to 4, the touch, the feeling, the softness of the textile sample after the treatment were inferior to those before the treatment. These properties could not be improved by the washing.

EXPERIMENTAL EXAMPLE 1

Using a colorimeter R-200 (manufactured by Minolta Camera Co., Ltd.), a color difference $\Delta E_{ab}$ between an untreated nylon-6 taffeta control and each of unwashed nylon-6 taffeta samples treated in Examples 1–6 and Comparative Examples 3 and 4 was measured. The results are shown in Table 8.

TABLE 6

Compound 11:

Triethylamine salt of $CF_3CF_2(CF_2CF_2)_3CH_2CH_2O-P(=O)(OH)_2$

Compound 12:

Triethylamine salt of $(CF_3)_2CF(CF_2CF_2)_4CH_2CH_2O-P(=O)(OH)_2$

TABLE 7

| | Nylon-6 taffeta | | | | Habutae silk | | | | Acrylic muslin | | | |
|---|---|---|---|---|---|---|---|---|---|---|---|---|
| | Before Wash | | After Wash | | Before Wash | | After Wash | | Before Wash | | After Wash | |
| | Water repellency | Oil repellency | Water repellency | Oil repellency | Water repellency | Oil repellency | Water repellency | Oil repellency | Water repellency | Oil repellency | Water repellency | Oil repellency |
| Ex. 1 | 100 | 5 | 80 | 2 | 80 | 6 | 70 | 3 | 90 | 6 | 60 | 3 |
| Ex. 2 | 90 | 6 | 60 | 1 | 90 | 5 | 60 | 2 | 70 | 6 | 60 | 2 |
| Ex. 3 | 90 | 6 | 60 | 1 | 70 | 5 | 50 | 1 | 80 | 6 | 60 | 4 |
| Ex. 4 | 90 | 5 | 70 | 2 | 80 | 5 | 60 | 3 | 80 | 6 | 60 | 3 |
| Ex. 5 | 90 | 5 | 60 | 1 | 80 | 5 | 60 | 2 | 70 | 6 | 60 | 2 |
| Ex. 6 | 90 | 5 | 60 | 1 | 70 | 5 | 60 | 1 | 80 | 5 | 60 | 3 |
| Ex. 7 | 90 | 5 | 70 | 1 | 80 | 4 | 60 | 1 | 80 | 5 | 60 | 2 |
| Ex. 8 | 80 | 5 | 60 | 1 | 80 | 4 | 60 | 1 | 70 | 5 | 50 | 1 |
| Ex. 9 | 80 | 5 | 50 | 1 | 70 | 3 | 50 | 1 | 70 | 4 | 50 | 1 |
| Ex. 10 | 80 | 5 | 60 | 1 | 80 | 4 | 50 | 2 | 70 | 5 | 50 | 1 |
| Ex. 11 | 80 | 4 | 50 | 1 | 80 | 4 | 50 | 1 | 70 | 5 | 60 | 1 |
| Ex. 12 | 80 | 4 | 50 | 1 | 60 | 3 | 50 | 1 | 80 | 5 | 50 | 1 |
| Com. Ex. 1 | 50 | 1 | 0 | 0 | 50 | 4 | 0 | 0 | 50 | 5 | 50 | 0 |
| Com. Ex. 2 | 80 | 1 | 0 | 0 | 0 | 0 | 0 | 0 | 80 | 2 | 50 | 0 |
| Com. Ex. 3 | 70 | 0 | 0 | 0 | 60 | 0 | 0 | 0 | 60 | 0 | 50 | 0 |
| Com. Ex. 4 | 80 | 2 | 50 | 0 | 70 | 2 | 50 | 0 | 80 | 2 | 50 | 0 |

TABLE 8

| | Color difference $\Delta E_{ab}$ |
|---|---|
| Ex. 1 | 2.44 |
| Ex. 2 | 0.21 |
| Ex. 3 | 0.65 |
| Ex. 4 | 1.88 |
| Ex. 5 | 0.43 |
| Ex. 6 | 0.79 |
| Com. Ex. 3 | 2.90 |
| Com. Ex. 4 | 10.57 |

EXAMPLE 13

First Step of Treatment

With immersing each of textile samples (polyester tropical for a dyeing test and nylon-6 taffeta for a dyeing test) in a 0.5% aqueous solution of chromium sulfate (Trade name: Bay Chrom F, manufactured by Bayer AG) (a bath ratio of 10:1) at 30° C., the textile sample was stirred in a dyeing tester (manufactured by Tsujii Senki Kogyo Kabushiki Kaisha) for 30 minutes. After water was squeezed from the textile, the textile was immersed in a 0.5% aqueous solution of a Compound 21 (a fluorine-containing phosphoric acid derivative) shown in Table 9 (a bath ratio of 10:1) at 50° C. for 30 minutes with stirring. After a 0.3% aqueous solution of formic acid was added to a bath containing the textile sample to adjust the pH of the bath to 3, the textile sample was stirred for 30 minutes, water was squeezed from the textile sample, and the textile sample was washed with water at 40° C. and dried at a room temperature.

Second Step of Treatment (Method A)

A fluorine-containing water- and oil-repellent [Tex guard TG-5431 and TG-5120 (both are manufactured by Daikin Industries Ltd.), and Asahi guard LS-317 (manufactured by Asahi Glass Co., Ltd.)] was diluted with tap water to a solid content of 1%, and isopropyl alcohol was added in an amount of 3% to prepare a treating liquid. The sample fabric treated in the first step was immersed in the treating liquid, squeezed with a mangle to give a wet pickup of 40% (in the case of the polyester fabric) or 25% (in the case of the nylon fabric), dried at 110° C. for 3 minutes and thermally treated at 160° C. for 1 minute.

The water repellency, the oil repellency and the feeling of each textile sample were measured before and after the washing. The results are shown in Table 10. In addition, the initial hot water repellency was measured. The results are shown in Table 11.

EXAMPLE 14

First Step of Treatment

The same procedure of the first step in Example 13 was repeated.

Second Step of Treatment (Method B)

The same procedure as in the second step of Example 13 was repeated except that the treating liquid further contained Erastron BN-69 (a blocked isocyanate manufactured by Dai-ichi Kogyo Seiyaku Co., Ltd.) in an amount of 2% and Erastron Catalyst (a catalyst manufactured by Dai-ichi Kogyo Seiyaku Co., Ltd.) in an amount of 0.2%.

The textile sample was evaluated as in Example 13. The results are shown in Tables 10 and 11.

EXAMPLE 15

First Step of Treatment

The same procedure of the first step in Example 13 was repeated.

Second Step of Treatment (Method C)

The same procedure as in the second step of Example 13 was repeated except that the treating liquid further contained Sumitex resin M-3 (methylol melamine manufactured by Sumitomo Chemical Co., Ltd.) in an amount of 0.3% and Sumitex accelerator (a catalyst manufactured by Sumitomo Chemical Co., Ltd.) in an amount of 0.3%.

The textile sample was evaluated as in Example 13. The results are shown in Tables 10 and 11.

COMPARATIVE EXAMPLE 5

Only Second Step (Method A)

Each of the same textile samples as used in Example 13 was subjected to only the second step (Method A) of Example 13. The textile sample was evaluated as in Example 13. The results are shown in Tables 10 and 11.

COMPARATIVE EXAMPLE 6

Only Second Step (Method B)

Each of the same textile samples as used in Example 13 was subjected to only the second step (Method B) of Example 14. The textile sample was evaluated as in Example 13. The results are shown in Tables 10 and 11.

COMPARATIVE EXAMPLE 7

Only Second Step (Method C)

Each of the same textile samples as used in Example 13 was subjected to only the second step (Method C) of Example 15. The textile sample was evaluated as in Example 13. The results are shown in Tables 10 and 11.

EXAMPLE 16

First Step of Treatment

The same procedure of the first step in Example 13 was repeated except that the treated textile samples were Ecsaine (a suede-type artificial leather manufactured by Toray Industries Inc.) and Soflinacial (an artificial napped leather manufactured by Kuraray Co., Ltd.).

Second Step of treatment (Method A)

A fluorine-containing water- and oil-repellent (Tex guard TG-5431 manufactured by Daikin Industries Ltd.) was diluted with tap water to a solid content of 1%, and isopropyl alcohol was added in an amount of 3% to prepare a treating liquid. The sample fabric treated in the first step was immersed in the treating liquid, squeezed with a mangle to give a wet pickup of 50% (in both of Ecsaine and Sofilinacial), dried at 110° C. for 3 minutes and thermally treated at 160° C. for 1 minute.

The water repellency, the oil repellency and the feeling of each textile sample were measured before and after the washing. The results are shown in Table 12.

EXAMPLE 17

First Step of Treatment

The same procedure as in the first step of Example 12 was repeated except that the same textile samples as used in Example 16 were used.

Second Step of Treatment (Method B)

The same procedure as in the second step of Example 16 was repeated except that the treating liquid further contained Erastron BN-69 (a blocked isocyanate manufactured by Dai-ichi Kogyo Seiyaku Co., Ltd.) in an amount of 2% and Erastron Catalyst (a catalyst manufactured by Dai-ichi Kogyo Seiyaku Co., Ltd.) in an amount of 0.2%.

The water repellency, the oil repellency and the feeling of each textile sample were evaluated before and after the washing. The results are shown in Table 12.

EXAMPLE 18

First Step of Treatment

The same procedure as in the first step of Example 16 was repeated.

Second Step of Treatment (Method C)

The same procedure as in the second step of Example 16 was repeated except that the treating liquid further contained Sumitex resin M-3 (methylol melamine manufactured by Sumitomo Chemical Co., Ltd.) in an amount of 0.3% and Sumitex accelerator (a catalyst manufactured by Sumitomo Chemical Co., Ltd.) in an amount of 0.3%.

The water repellency, the oil repellency and the feeling of each textile sample were evaluated before and after the washing. The results are shown in Table 12.

COMPARATIVE EXAMPLE 8

Only Second Step (Method A)

Each of the same textile samples as used in Example 16 was subjected to only the second treatment (Method A) of Example 16. The water repellency, the oil repellency and the feeling of the textile sample were measured before and after the washing. The results are shown in Table 12.

COMPARATIVE EXAMPLE 9

Only Second Step (Method B)

Each of the same textile samples as used in Example 16 was subjected to only the second treatment (Method B) of Example 17. The water repellency, the oil repellency and the feeling of the textile sample were measured before and after the washing. The results are shown in Table 12.

COMPARATIVE EXAMPLE 10

Only Second Step (Method C)

Each of the same textile samples as used in Example 16 was subjected to only the second treatment (Method C) of Example 18. The water repellency, the oil repellency and the feeling of the textile sample were measured before and after the washing. The results are shown in Table 12.

TABLE 9

| |
|---|
| Compound 21: |
| Triethylamine salt of $CF_3CF_2(CF_2CF_2)_nCH_2CH_2O-P(=O)(OH)_2$ |
| (a mixture of compounds wherein n is 3, 4, 5 and 6 (a molar ratio of the compounds is 5:3:2:1) |

TABLE 10

| | | Water repellency | | | Oil repellency | | | Feeling | | |
|---|---|---|---|---|---|---|---|---|---|---|
| | | TG-5431 | TG-5120 | LS-317 | TG-5431 | TG-5120 | LS-317 | TG-5431 | TG-5120 | LS-317 |
| Polyester Tropical | | | | | | | | | | |
| Ex. 13 | $L_0$ | $100^+$ | $100^+$ | $100^+$ | 7 | 5 | 7 | ○ | ○ | ○ |
| | $L_{20}$ | $100^+$ | $80^+$ | $90^+$ | 5 | 3 | 5 | ○ | ○ | ○ |
| Ex. 14 | $L_0$ | $100^+$ | $100^+$ | $100^+$ | 6 | 5 | 6 | ○ | ○ | ○ |
| | $L_{20}$ | $90^+$ | $80^+$ | $90^-$ | 4 | 3 | 4 | ○ | ○ | ○ |
| Ex. 15 | $L_0$ | $100^+$ | $100^+$ | $100^+$ | 7 | 6 | 7 | ○ | ○ | ○ |
| | $L_{20}$ | $100^+$ | 90 | 100 | 5 | 2 | 5 | ○ | ○ | ○ |
| Com. | $L_0$ | $100^+$ | $100^+$ | $100^+$ | 6 | 5 | 6 | Δ | Δ | X |
| Ex. 5 | $L_{20}$ | 90 | 70 | $80^+$ | 4 | 0 | 4 | Δ | Δ | X |
| Com. | $L_0$ | $100^+$ | $100^+$ | $100^+$ | 6 | 4 | 6 | X | Δ | X |
| Ex. 6 | $L_{20}$ | 80 | 80 | $70^+$ | 4 | 1 | 4 | X | Δ | X |
| Com. | $L_0$ | $100^+$ | $100^+$ | $100^+$ | 6 | 6 | 6 | X | X | X |
| Ex. 7 | $L_{20}$ | $90^+$ | $80^+$ | $90^+$ | 5 | 0 | 4 | X | X | X |
| Nylon taffeta | | | | | | | | | | |
| Ex. 13 | $L_0$ | $100^+$ | $100^+$ | $100^+$ | 4 | 4 | 4 | ○ | ○ | ○ |
| | $L_{20}$ | $80^+$ | $80^-$ | 70 | 0 | 0 | 0 | ○ | ○ | ○ |
| Ex. 14 | $L_0$ | $100^+$ | $100^+$ | $100^+$ | 4 | 3 | 4 | ○ | ○ | ○ |
| | $L_{20}$ | $80^+$ | $80^-$ | 80 | 0 | 0 | 0 | ○ | ○ | ○ |
| Ex. 15 | $L_0$ | $100^+$ | $100^+$ | $100^+$ | 5 | 4 | 4 | ○ | ○ | ○ |
| | $L_{20}$ | $80^+$ | 80 | 70 | 0 | 0 | 0 | ○ | ○ | ○ |
| Com. | $L_0$ | $100^+$ | $100^+$ | $100^+$ | 4 | 4 | 1 | Δ | Δ | X |
| Ex. 5 | $L_{20}$ | 70 | 70 | 0 | 0 | 0 | 0 | Δ | Δ | X |
| Com. | $L_0$ | $100^+$ | $100^+$ | $100^+$ | 4 | 2 | 4 | X | Δ | X |
| Ex. 6 | $L_{20}$ | 70 | 70 | 50 | 0 | 0 | 0 | X | Δ | X |
| Com. | $L_0$ | $100^+$ | $100^+$ | $100^+$ | 4 | 1 | 1 | X | X | X |
| Ex. 7 | $L_{20}$ | 0 | 50 | 0 | 0 | 0 | 0 | X | X | X |

Note: $L_0$ indicates one before the washing, and $L_{20}$ indicates one after washing 20 times.
The feeling is expressed as follows:
○: soft,
Δ: slightly hard, and
X: hard.

TABLE 11

| | TG-5431 | TG-5120 | LS-317 |
|---|---|---|---|
| Polyester tropical | | | |
| Ex. 13 | $90^+$ | $90^+$ | $90^+$ |
| Ex. 14 | $90^+$ | 90 | 90 |
| Ex. 15 | 100 | $90^+$ | 90+ |
| Com. Ex. 5 | 80 | 50 | 70 |
| Com. Ex. 6 | 70 | 50 | 50 |
| Com. Ex. 7 | $80^+$ | 50 | 50 |
| Nylon taffeta | | | |
| Ex. 13 | $90^+$ | $90^+$ | $90^+$ |
| Ex. 14 | $90^+$ | $90^+$ | 90 |
| Ex. 15 | 100 | $90^+$ | $90^+$ |
| Com. Ex. 5 | 50 | 0 | 50 |
| Com. Ex. 6 | 50 | 0 | 50 |
| Com. Ex. 7 | 50 | 0 | 50 |

TABLE 12

| | | Water repellency | Oil repellency | Feeling |
|---|---|---|---|---|
| Ecsaine | | | | |
| Ex. 16 | $L_0$ | $100^+$ | 6 | ○ |
| | $L_{20}$ | $80^+$ | 4 | ○ |

TABLE 12-continued

| | | Water repellency | Oil repellency | Feeling |
|---|---|---|---|---|
| Ex. 17 | $L_0$ | $100^+$ | 6 | ○ |
| | $L_{20}$ | 80 | 4 | ○ |
| Ex. 18 | $L_0$ | $100^+$ | 6 | ○ |
| | $L_{20}$ | $80^+$ | 4 | ○ |
| Com. | $L_0$ | $100^+$ | 6 | Δ |
| Ex. 8 | $L_{20}$ | 80 | 0 | Δ |
| Com. | $L_0$ | $100^+$ | 6 | X |
| Ex. 9 | $L_{20}$ | $80^-$ | 2 | X |
| Com. | $L_0$ | $100^+$ | 6 | X |
| Ex. 10 | $L_{20}$ | 80 | 2 | X |
| Soflinacial | | | | |
| Ex. 16 | $L_0$ | $100^+$ | 6 | ○ |
| | $L_{20}$ | 50 | 0 | ○ |
| Ex. 17 | $L_0$ | $100^+$ | 6 | ○ |
| | $L_{20}$ | 80 | 0 | ○ |
| Ex. 18 | $L_0$ | $100^+$ | 6 | ○ |
| | $L_{20}$ | 80 | 1 | ○ |
| Com. | $L_0$ | $100^+$ | 5 | Δ |
| Ex. 8 | $L_{20}$ | 0 | 0 | Δ |
| Com. | $L_0$ | $100^+$ | 6 | X |
| Ex. 9 | $L_{20}$ | 50 | 0 | X |
| Com. | $L_0$ | $100^+$ | 3 | X |
| Ex. 10 | $L_{20}$ | 50 | 0 | X |

Note: $L_0$ indicates one before the washing, and $L_{20}$ indicates one after washing 20 times.
The feeling is expressed as follows:
○: soft, TABLE 12-continued

| | Water repellency | Oil repellency | Feeling |
|---|---|---|---|

Δ: slightly hard, and
X: hard.

EXAMPLE 19

A nylon loop pile carpet sample was stirred in a dyeing tester (manufactured by Tsujii Senki Kogyo Kabushiki Kaisha) for 30 minutes with immersed in a 0.5% aqueous solution of chromium sulfate (trade name: Bay Chrom F, manufactured by Bay AG) (a bath ratio of 10:1) at 30° C. Water was squeezed from the sample. The sample was stirred for 30 minutes with immersed in a 0.5% aqueous solution of Compound 21 (a fluorine-containing phosphoric acid derivative) (a bath ratio of 10:1) shown in Table 9 at 50° C. A 0.3% aqueous solution of formic acid was added to the bath to adjust pH of the content of the bath to 3. The carpet sample was stirred for 30 minutes and washed with water at 40° C. and dried at a room temperature.

The dry soil releasability, the feeling before and after the rub, the water repellency and the oil repellency of the treated sample were evaluated. The results are shown in Table 13.

EXAMPLE 20

A liquid prepared by diluting a fluorine-containing water- and oil-repellent (TG-950 manufactured by Daikin Industries Ltd. (a solid content of 30%)) with tap water by 10 times was sprayed in an application amount of 75 g/m$^2$ on the carpet sample subjected to the treatment of Example 19 and then the carpet sample was dried at 130° C. for 3 minutes. The carpet sample was evaluated in the same manner as in Example 19. The results are shown in Table 13.

EXAMPLE 21

A liquid prepared by diluting a fluorine-containing water- and oil-repellent (TG-951 manufactured by Daikin Industries Ltd. (a solid content of 30%)) with tap water by 10 times was sprayed in an application amount of 75 g/m$^2$ on the carpet sample subjected to the treatment of Example 19 and then the carpet sample was dried at 130° C. for 3 minutes. The carpet sample was evaluated in the same manner as in Example 19. The results are shown in Table 13.

EXAMPLE 22

A liquid prepared by diluting a fluorine-containing water- and oil-repellent (AG-800 manufactured by Asahi Glass Co., Ltd. (a solid content of 30%)) with tap water by 10 times was sprayed in an application amount of 75 g/m$^2$ on the carpet sample subjected to the treatment of Example 19 and then the carpet sample was dried at 130° C. for 3 minutes. The carpet sample was evaluated in the same manner as in Example 19. The results are shown in Table 13.

EXAMPLE 23

A liquid prepared by diluting a silicone stainproofing agent (Bayguard AS manufactured by Bay AG (a solid content of 6%)) with tap water by 10 times was sprayed in an application amount of 75 g/m$^2$ on the carpet sample subjected to the treatment of Example 19 and then the carpet sample was dried at 130° C. for 3 minutes. The carpet sample was evaluated in the same manner as in Example 19. The results are shown in Table 13.

COMPARATIVE EXAMPLE 11

A liquid prepared by diluting TG-950 with tap water by 10 times was sprayed in an application amount of 75 g/m$^2$ on the same nylon loop pile carpet sample as used in Example 19 and then the carpet sample was dried at 130° C. for 3 minutes. The carpet sample was evaluated in the same manner as in Example 19. The results are shown in Table 13.

COMPARATIVE EXAMPLE 12

A liquid prepared by diluting TG-951 with tap water by 10 times was sprayed in an application amount of 75 g/m$^2$ on the same nylon loop pile carpet sample as used in Example 19 and then the carpet sample was dried at 130° C. for 3 minutes. The carpet sample was evaluated in the same manner as in Example 19. The results are shown in Table 13.

COMPARATIVE EXAMPLE 13

A liquid prepared by diluting AG-800 with tap water by 10 times was sprayed in an application amount of 75 g/m$^2$ on the same nylon loop pile carpet sample as used in Example 19 and then the carpet sample was dried at 130° C. for 3 minutes. The carpet sample was evaluated in the same manner as in Example 19. The results are shown in Table 13.

COMPARATIVE EXAMPLE 14

A liquid prepared by diluting Bayguard AS with tap water by 10 times was sprayed in an application amount of 75 g/m$^2$ on the same nylon loop pile carpet sample as used in Example 19 and then the carpet sample was dried at 130° C. for 3 minutes. The carpet sample was evaluated in the same manner as in Example 19. The results are shown in Table 13.

TABLE 13

| | | Feeling | Water repellency | Oil repellency | Dry soil releasability Contamination rate (%) |
|---|---|---|---|---|---|
| Ex. 19 | Before rubbing | ○ | 20 | 3 | 18 |
| | After rubbing | ○ | 20 | 3 | |
| Ex. 20 | Before rubbing | ○ | 40 | 4 | 22 |
| | After rubbing | ○ | 30 | 4 | |
| Ex. 21 | Before rubbing | ○ | 30 | 3 | 19 |
| | After rubbing | ○ | 20 | 3 | |
| Ex. 22 | Before rubbing | ○ | 30 | 4 | 20 |
| | After rubbing | ○ | 20 | 4 | |
| Ex. 23 | Before rubbing | ○ | 10 | 1 | 20 |
| | After rubbing | ○ | 10 | 0 | |
| Com. | Before rubbing | Δ | 40 | 4 | 35 |
| Ex. 11 | After rubbing | Δ | 20 | 2 | |
| Com. | Before rubbing | Δ | 30 | 3 | 33 |
| Ex. 12 | After rubbing | Δ | 10 | 1 | |
| Com. | Before rubbing | X | 30 | 4 | 34 |
| Ex. 13 | After rubbing | X | 10 | 2 | |
| Com. | Before rubbing | Δ | 0 | 0 | 40 |
| Ex. 14 | After rubbing | Δ | 0 | 0 | |

Note: Dry soil releasability: The contamination rate of the untreated textile was 54%.

REFERENCE EXAMPLE 1 (Example showing the preparation of a test fabric)

A wool muslin fabric for a dyeing test was stirred in a dyeing tester (manufactured by Tsujii Senki Kogyo Kabushiki Kaisha) for 10 minutes with immersed in an aqueous hydrochloric acid solution having a temperature of 25° C. (the amounts of water and 35% concentrated hydrochloric acid were 3,000% and 6%, respectively, based on the fabric sample). An aqueous solution of sodium hypochlorite was added so that the amount of active chlorine concentration was 1% by weight based on the fabric sample and then the sample was further stirred for 30 minutes. The content of the bath was removed and an aqueous solution of sodium carbonate having a temperature of 25° C. (the amounts of water and sodium carbonate were 3,000% and 4%, respectively, based on the fabric sample) was charged in the bath so that the fabric was immersed therein. Sodium sulfite in an amount of 4% based on the fabric sample was added to the bath and the sample was stirred for 10 minutes. The content of the bath was removed, the sample was washed with water and air-dried to give a descaled wool fabric sample.

EXAMPLE 24

Each of two textile samples (a descaled wool fabric sample prepared in Reference Example 1; and a nylon-6 fabric for a dyeing test) was stirred in a dyeing tester (manufactured by Tsujii Senki Kogyo Kabushiki Kaisha) for 30 minutes with immersed in a 0.5% aqueous solution of chromium sulfate (trade name: Bay Chrom F manufactured by Bay AG) (a bath ratio of 10:1) at 30° C. Water was squeezed from the sample. The sample was stirred for 30 minutes with immersed in a 0.5 % aqueous solution of Compound 31 (a fluorine-containing phosphoric acid derivative) (a bath ratio of 10:1) shown in Table 14 at 50° C. A 0.3 % aqueous solution of formic acid was added to the bath to adjust pH of the content in the bath to 3. The fabric sample was stirred for 30 minutes and water was squeezed from the fabric sample. The fabric sample was washed with water at 40° C. and dried at a room temperature.

The water repellency, the oil repellency and the feeling of the treated textile sample were measured before and after the washing. The results are shown in Table 15.

EXAMPLE 25

First Step of Treatment

The same procedure as in Example 24 was repeated.

Second Step of Treatment (Method A)

A fluorine-containing water- and oil-repellent (Tex guard TG-5431 manufactured by Daikin Industries Ltd.) was diluted with tap water to a solid content of 1%, and isopropyl alcohol was added in an amount of 3% to prepare a treating liquid. The fabric sample treated in the first step was immersed in the treating liquid, squeezed with a mangle to give a wet pickup of 65% (for the wool fabric) or 25% (for the nylon fabric), dried at 110° C. for 3 minutes and thermally treated at 160° C. for 1 minute.

The fabric was evaluated in the same manner as in Example 24. The results are shown in Table 15.

EXAMPLE 26

First Step of Treatment

The same procedure as in Example 24 was repeated.

Second Step of Treatment (Method B)

The same procedure as in the second step of Example 25 was repeated except that the treating liquid further contained Erastron BN-69 (a blocked isocyanate manufactured by Dai-ichi Kogyo Seiyaku Co., Ltd.) in an amount of 2% and Erastron Catalyst (a catalyst manufactured by Dai-ichi Kogyo Seiyaku Co., Ltd.) in an amount of 0.2%.

The fabric was evaluated in the same manner as in Example 24. The results are shown in Table 15.

EXAMPLE 27

First Step of Treatment

The same procedure as in Example 24 was repeated.

Second Step of Treatment (Method C)

The same procedure as in the second step of Example 25 was repeated except that the treating liquid further contained Sumitex resin M-3 (methylol melamine manufactured by Sumitomo Chemical Co., Ltd.) in an amount of 0.3% and Sumitex Accelerator (a catalyst manufactured by Sumitomo Chemical Co., Ltd.) in an amount of 0.3.

The fabric was evaluated in the same manner as in Example 24. The results are shown in Table 15.

EXAMPLE 28

The same procedure as in Example 24 was repeated except that Compound 32 shown in Table 14 was used as the fluorine-containing phosphoric acid derivative. The results are shown in Table 15.

EXAMPLE 29

The same procedure as in Example 25 was repeated except that Compound 32 was used as the fluorine-containing phosphoric acid derivative. The results are shown in Table 15.

EXAMPLE 30

The same procedure as in Example 26 was repeated except that Compound 32 was used as the fluorine-containing phosphoric acid derivative. The results are shown in Table 15.

EXAMPLE 31

The same procedure as in Example 27 was repeated except that Compound 32 was used as the fluorine-containing phosphoric acid derivative. The results are shown in Table 15.

COMPARATIVE EXAMPLE 15

Only Second Step (Method A)

Each of the same textile samples as used in Example 24 was subjected to only the second step (Method A) of Example 25. The samples were evaluated as in Example 24. The results are shown in Table 15.

COMPARATIVE EXAMPLE 16

Only Second Step (Method B)

Each of the same textile samples as used in Example 24 was subjected to only the second step (Method B) of Example 26. The samples were evaluated as in Example 24. The results are shown in Table 15.

COMPARATIVE EXAMPLE 17

Only Second Step (Method C)

Each of the same textile samples as used in Example 24 was subjected to only the second step (Method C) of Example 27. The samples were evaluated as in Example 24. The results are shown in Table 15.

TABLE 14

Compound 31:

Diethanolamine salt of $CF_3CF_2(CF_2CF_2)_nCH_2CH_2O$ $\diagdown$ O ‖ P—OH $\diagup$ $CF_3CF_2(CF_2CF_2)_nCH_2CH_2O$ (a mixture of compounds wherein n is 3, 4, 5 and 6 (a molar ratio of the compounds is 5:3:2:1)

Compound 32:

Triethylamine salt of $CF_3CF_2(CF_2CF_2)_nCH_2CH_2$—P(=O)(OH)(OH)

(a mixture of compounds wherein n is 3, 4, 5 and 6 (a molar ratio of the compounds is 5:3:2:1)

TABLE 15

| | | Descaled wool | | | Nylon taffeta | | |
|---|---|---|---|---|---|---|---|
| | | Feeling | Water repellency | Oil repellency | Feeling | Water repellency | Oil repellency |
| Ex. 24 | $L_0$ | ○ | $100^+$ | 6 | ○ | 100 | 6 |
| | $L_{20}$ | ○ | $90^+$ | 2 | ○ | 70 | 4 |
| Ex. 25 | $L_0$ | ○ | $100^+$ | 6 | ○ | 100 | 6 |
| | $L_{20}$ | ○ | 90 | 2 | ○ | 100 | 6 |
| Ex. 26 | $L_0$ | ○ | $100^+$ | 6 | ○ | 100 | 6 |
| | $L_{20}$ | ○ | $90^+$ | 3 | ○ | $80^+$ | 5 |
| Ex. 27 | $L_0$ | ○ | $100^+$ | 6 | ○ | 100 | 6 |
| | $L_{20}$ | ○ | 100 | 3 | ○ | $80^+$ | 5 |
| Ex. 28 | $L_0$ | ○ | $100^+$ | 6 | ○ | $100^+$ | 4 |
| | $L_{20}$ | ○ | 70 | 0 | ○ | 80 | 0 |
| Ex. 29 | $L_0$ | ○ | $100^+$ | 6 | ○ | $100^+$ | 4 |
| | $L_{20}$ | ○ | 70 | 0 | ○ | 80 | 0 |
| Ex. 30 | $L_0$ | ○ | $100^+$ | 6 | ○ | $100^+$ | 4 |
| | $L_{20}$ | ○ | $80^+$ | 0 | ○ | 80 | 0 |
| Ex. 31 | $L_0$ | ○ | $100^+$ | 6 | ○ | $100^+$ | 4 |
| | $L_{20}$ | ○ | 80 | 0 | ○ | 80 | 0 |
| Com. | $L_0$ | Δ | $100^+$ | 6 | Δ | $100^+$ | 4 |
| Ex. 15 | $L_{20}$ | Δ | 50 | 0 | Δ | 70 | 0 |
| Com. | $L_0$ | X | $100^+$ | 6 | X | $100^+$ | 4 |
| Ex. 16 | $L_{20}$ | X | 50 | 0 | X | 70 | 0 |
| Com. | $L_0$ | X | $100^+$ | 6 | X | $100^+$ | 4 |
| Ex. 17 | $L_{20}$ | X | 50 | 0 | X | 0 | 0 |

Note: $L_0$ indicates one before the washing, and $L_{20}$ indicates one after washing 20 times.
The feeling is expressed as follows:
○: soft,
Δ: slightly hard, and
X: hard.

EFFECT OF THE INVENTION

According to the present invention, the touch, feeling, color shade and softness originally possessed by the fibers can be kept after the textile is treated. The present invention can keep the above properties at desired levels even if the textile is subjected to a long time use in which the textile is washed or rubbed. The present invention can impart to the textile the hot water repellency, the durable water- and oil-repellency and the resistance to contamination.

What is claimed is:

1. A method for treating a textile which comprises immersing the textile into a solution which contains a modifying agent and immersing the textile into a solution which contains a fixing agent, wherein the modifying agent is a fluorine-containing phosphoric acid derivative represented by the formula

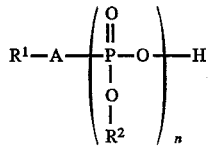

(I)

or a salt thereof, wherein $R^1$ and $R^2$ are the same or different, and are each a hydrogen atom or $R_f(CH_2)_m$—, wherein $R_f$ is a saturated or unsaturated, linear or branched fluorine-containing aliphatic group having 4 to 20 carbon atoms which is unsubstituted or is Substituted with a substituent selected from the group consisting of an oxygen atom a nitrogen atom, a sulfonyl group, an aromatic ring and combinations thereof, wherein said substituent is bonded to one or more carbon atoms of said aliphatic group; m is 1 or 2; and $R^1$ and $R^2$ each is non simultaneously a hydrogen atom; A is an oxygen tom, a sulfur atom or a direct bond; and n is 1 or 2; and wherein said modifying agent has a molecular weight of not larger than 2,000, and the fixing agent is a metal compound that is at least one selected from the group consisting of chlorides, nitrate salts, sulfate salts and hydroxides of chromium, zirconium, titanium and aluminum.

2. The method according to claim 1, wherein the textile is treated by immersing the textile into a solution of the fixing agent and then immersing the textile into a solution of the modifying agent.

3. The method according to claim 1, wherein the textile is treated by immersing the textile into a solution of the modifying agent and then immersing the textile into a solution of the fixing agent.

4. A method for treating a textile, comprising treating the textile by the method according to claim 2 or 3, and then with a fluorine-containing water- and oil-repellent.

5. The method according to claim 1, wherein fixing agent metal salt is formed from a metal selected from the group consisting of zirconium, titanium and aluminum; and wherein the fluorine-containing phosphoric acid derivative modifying agent is a compound selected from the group consisting of:

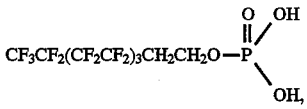

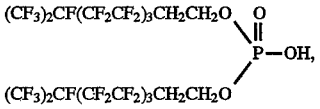

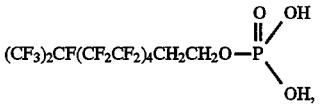

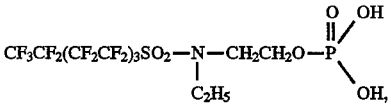

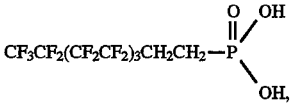

-continued

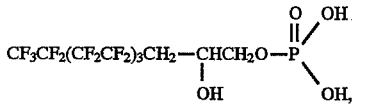

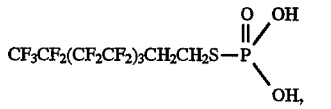

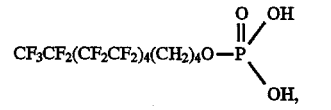

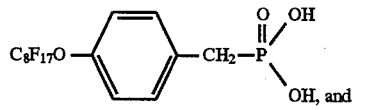

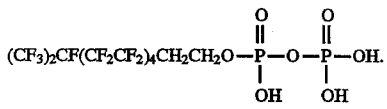

6. A method for treating a textile which comprises immersing the textile into a solution which contains a treatment agent, and then treating the textile with a fluorine-containing water- and oil-repellent, wherein said treatment agent comprises a combination of a modifying agent and a fixing agent, wherein the modifying agent is a fluorine-containing phosphoric acid derivative represented by the formula

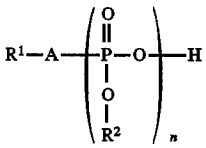

(I)

or a salt thereof, wherein $R^1$ and $R^2$ are the same or different, and are each a hydrogen atom or $R_f$—$(CH_2)_m$—, wherein $R_f$ is a saturated or unsaturated, linear or branched fluorine-containing aliphatic group having 4 to 20 carbon atoms which is unsubstituted or is substituted with a substituent selected from the group consisting of an oxygen atom, a nitrogen atom, a sulfonyl group, an aromatic ring and combinations thereof, wherein said substituent is bonded to one or more carbon atoms of said aliphatic group; m is 1 or 2; and $R^1$ and $R^2$ each is not simultaneously a hydrogen atom; A is an oxygen atom, a sulfur atom or a direct bond; and n is 1 or 2; and wherein said modifying agent has a molecular weight of not larger than 2,000, and the fixing agent is a metal salt compound that is at least one selected from the group consisting of chlorides, nitrate salts, sulfate salts and hydroxides of chromium, zirconium, titanium and aluminum.

7. A textile which is treated with the method according to claim 8.

8. The textile according to claim 7, which is at least one member selected from the group consisting of a fiber, a yarn, a woven fabric, a knitted fabric and a nonwoven fabric.

9. The textile according to claim 7, wherein the textile comprises a natural fiber and/or a synthetic fiber.

10. The textile according to claim 9, wherein the natural fiber is at least one selected from the group consisting of cotton, wool and silk.

11. The textile according to claim 9, wherein the synthetic fiber is at least one selected from the group consisting of an acrylic, a nylon, a cellulose and a polyester.

12. The textile according to claim 9, which comprises a protein fiber and/or a polyamide fiber.

13. The textile according to claim 7, which is at least one selected from the group consisting of an extra fine fiber, a yarn formed from the extra fine fibers a woven fabric formed from the extra fine fiber, a knitted fabric formed from the extra fine fiber, and a nonwoven fabric formed from the extra fine fiber.

14. The textile according to claim 13, which is an artificial leather comprising the extra fine fiber.

15. The textile according to claim 13, wherein the diameter of the extra fine fiber is not larger than 1 denier.

16. The textile according to claim 13, wherein the diameter of the extra fine fiber is from 1.0 to 0.0001 denier.

17. A textile according to claim 7, which is in the form of an umbrella, clothes, footwear, a suitcase, a bag, a cover for an article having a seat, and an article for an interior of a building or vehicle.

18. A method for treating a carpet, which comprises treating a carpet by immersing the carpet into a solution which contains having a diameter not larger than 1 denier, wherein the modifying agent is a fluorine-containing phosphoric acid derivative represented by the formula

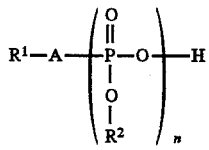

(I)

or a salt thereof, wherein $R^1$ and $R^2$ are the same or different, and are each a hydrogen atom or $R_f$—$(CH_2)_m$—, wherein $R_f$ is a saturated or unsaturated, linear or branched fluorine-containing aliphatic group having 4 to 20 carbon atoms which is unsubstituted or is substituted with a substituent selected from the group consisting of an oxygen atom a nitrogen atom, a sulfonyl group, an aromatic ring and combinations thereof, wherein said substituent is bonded to one or more carbon atoms of said aliphatic group; m is 1 or 2; and $R^1$ and $R^2$ each is not simultaneously a hydrogen atom; A is an oxygen atom, a sulfur atom or a direct bond; and n is 1 or 2; and wherein said modifying agent has a molecular weight of not larger than 2,000, and the fixing agent is a metal compound that is at least one selected from the group consisting of chlorides, nitrate salts, sulfate salts and hydroxides of chromium, zirconium, titanium and aluminum.

19. A method for treating a carpet according to claim wherein the carpet is treated by immersing the carpet into a solution of the fixing agent and then immersing the carpet into a solution of the modifying agent.

20. A method for treating a carpet according to claim 18, wherein the carpet is treated by immersing the carpet into a solution of the modifying agent and then immersing the carpet into a solution of the fixing agent.

21. A method for treating a carpet comprising treating the carpet with the method according to claim 18 and then treating the carpet with a fluorine-containing water- and oil-repellant.

22. A method for treating a carpet, comprising treating the carpet by the method according to claim 19 or 20, and then treating the carpet with a fluorine-containing water- and oil-repellent.

23. A method for treating a carpet, comprising treating the carpet by the method according to claim 19, and then treating the carpet with a fluorine-containing stainproofing agent.

24. A carpet which is treated with the method according to claim 18.

25. A carpet which is treated with the method according to claim 21.

26. A carpet having durable soil releasability which is treated with the method according to claim 23.

* * * * *